United States Patent [19]

Guinan

[11] 4,155,369

[45] May 22, 1979

[54] HAIR SEPARATOR FOR BLEACHING SELECTIVE PORTIONS OF HAIR

[76] Inventor: John J. Guinan, 13321 Trendwood Dr., Omaha, Nebr. 68144

[21] Appl. No.: 627,978

[22] Filed: Nov. 3, 1975

[51] Int. Cl.[2] ..... A45D 19/00

[52] U.S. Cl. ..... 132/9

[58] Field of Search ..... 132/9, 7, 49

[56] References Cited

U.S. PATENT DOCUMENTS

| | | | |
|---|---|---|---|
| 2,818,074 | 12/1957 | Mach | 132/9 |
| 3,249,113 | 5/1966 | Sobeck | 132/9 |
| 3,270,753 | 9/1966 | Cook et al. | 132/9 |
| 3,304,945 | 2/1967 | Anderson | 132/9 |

*Primary Examiner*—G. E. McNeill

[57] ABSTRACT

A hair separator comprising a cap of waterproof material, having openings in it through which selective portions of hair can be pulled, wall means surrounding the openings, and plugs disposed in each of said walls and forming substantially a sealing relationship therewith, whereby hair treatment liquids are substantially blocked from passing through said cap openings, whereby hair projecting outwardly from said plugs can be selectively treated.

10 Claims, 5 Drawing Figures

HAIR SEPARATOR FOR BLEACHING SELECTIVE PORTIONS OF HAIR

FIELD OF THE INVENTION

This invention is in the field of devices for facilitating the selective treatment of portions of hair of the head of a person, such as for example the bleaching or selective coloring thereof.

DESCRIPTION OF THE PRIOR ART

In the prior art no cap designed for selective portions of hair to be drawn through openings therein for selective treatment has been sufficiently leak-proof in my opinion.

It seems very desirable to me that the cap be so designed that the hair treatment solutions can be freely used and freely flow across the cap without danger of seeping down through crevices into the main body of the hair portions beneath the cap.

It is not sufficient that the openings of the cap be so tiny that hair portions can be drawn therethrough with the resiliency of the cap itself being a sufficient compressing force against the hair portions as to cause a sealing effect. This is because if this is the way it is done it is very difficult to pull the hair through holes in the cap because they are so tiny and great labor is involved in using a hook to pull them through, causing pain for the customer.

Other devices separate from a cap and used also to compress selective hair portions have been proposed without completely effective sealing of them to the cap itself, so as to prevent leakage through to the scalp.

SUMMARY OF THE INVENTION

A principle object of this invention is to provide a hair separator comprising a cap of waterproof material, having openings in it through which selective portions of hair can be pulled, wall means surrounding the openings, and plugs disposed in each of said walls and forming substantially a sealing relationship therewith, whereby hair treatment liquids are substantially blocked from passing through said cap openings, whereby hair projecting outwardly from said plugs can be selectively treated.

DESCRIPTION OF THE PREFERRED EMBODIMENTS

Figure 1:
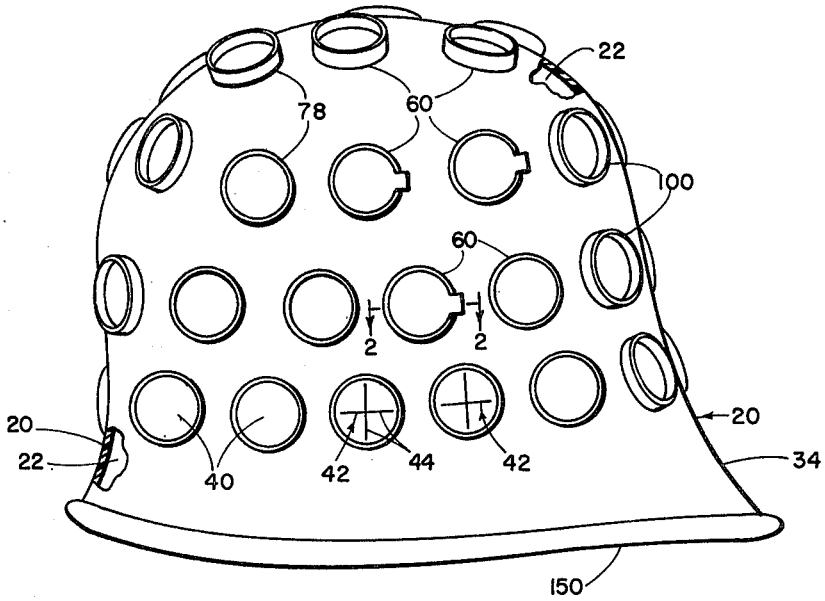
FIG. 1 is a side elevation of a cap of this invention, shown with hair openings therethrough, but with only certain of the walls surrounding the hair openings being plugged with plugs so as to indicate an intermediate state in the preparation for hair treatment.

Referring to FIG. 1 a hair cover or cap is there generally indicated at 20 and is preferably formed of a flexible stretchable material such as thermoplastic or rubber.

The cap 20 has a cavity on its underside as seen at 22 and of a size for receiving substantially all of that part of a person's head which has the head-top hair thereon and further for extending down beyond the ears of a person so as to effectively protect the person's head from various liquids used in treating the hair.

The bottom-most portion of the cap is outwardly flared as seen at 34.

A plurality of openings 40 and 42 are disposed an equidistantly spaced apart places all over the top and sides of the cap 20. The openings 40 are shown simply to be circular and about three-fourths inch in diameter or about one inch in diameter and are for the purpose of allowing a wisp or portion of hair such as shown at 100 in FIG. 2 to extend upwardly through the opening 40 from a person's head and thereby outside of the cap where it can be treated.

Figure 4:
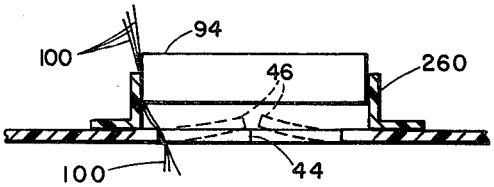
FIG. 4 is a view similar to FIG. 1 but of a modified plug and a modified socket.

The openings 42 are an alternate form of openings that can be used and the openings 42 are in effect each formed of two criss-cross slits 44 which intersect each other at right angles, as shown in FIG. 1, and also shown in FIG. 4, so that portions of the cap 20 which are between the slits 44 can yield away from each other somewhat as seen in FIG. 4 at the numeral 46, whereby they permit hair to extend upwardly through the slits 44.

Figure 2:
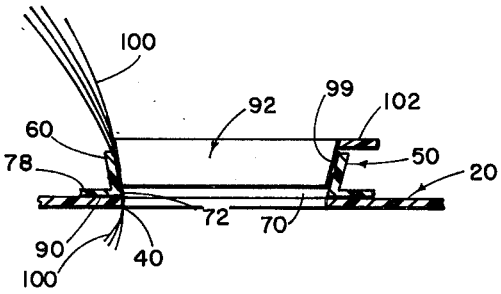
FIG. 2 is a sectional view taken along the line 2—2 of FIG. 1, but showing the plug not being in section, and showing a tress of hair to be treated extending between a plug and a wall and thereby outwardly of the cap.

In FIG. 2 a hair-holding assembly is generally indicated at 50 and has a socket or annular wall portion 60 which forms a side wall of the assembly 50.

Each socket 60 of FIG. 2 has an inner wall 70 which is of frustro-conical shape tapering from a portion nearest the cap 20 which is of lesser diameter to a larger diameter at the outer end thereof. The socket 60 is of one piece with a flange 78 which can be called a mounting flange and which latter is parallel to adjacent portions of the cap 20 and is suitably secured thereto by a bonding agent or other means, such as being heat-welded thereto.

The reason for this construction is that the flange 78 and the socket 60 are both preferably formed of relatively stiff material as compared to the cap 20, the cap 20 being of thinner and yielding and stretchable material, or at the least very flexible material, whereas it is much better that the socket 60 and flange 78 be stiffer.

Those portions 72 of the inner wall 70 which are nearest the cap 20 preferably join the edges of the opening 40 or are near the edges of the slit opening 42 when the latter type of opening is used.

The bonding of the flange 78, which is annular, to the cap 20 is of a water-type nature, such bonding being shown at 90.

Figure 5:
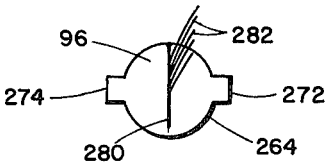
FIG. 5 is a view of a modified plug having two tabs and, as seen in top plan view, the plug of FIG. 5 also has a slit through it for receiving a tress of hair as shown.

A plug is provided for each of the sockets 60 and such plug can be of the type shown at 92 in FIG. 2, 94 in FIG. 4 or 96 in FIG. 5. The plug 92 has side walls 99 that are of frustro-conical shape of narrower diameter at the end thereof that is closest to the cover 20 and of larger diameter at the outer end thereof. At the outer portion of the plug 92 is a tab 102 which extends across the outer side of the respective socket 60 so as to facilitate its being gripped by the fingers for pulling the plug out of the socket.

Even though a part or a portion or tress of hair shown at 100, and consisting of a number of strands, is disposed between the plug 92 and the socket 60, yet the tight wedging of the plug 92 and the socket 60 make it a water-tight fit therebetween or substantially so, so that no substantial quantity of liquid can seep down towards the person's head under the cap 20 through the opening 40.

When the hair-holding assembly is constructed in this way liquids can be handled freely above the cap and none will get through to the head of a patron, nor to those portions of the patron's hair which are under the cap 20.

Figure 3:
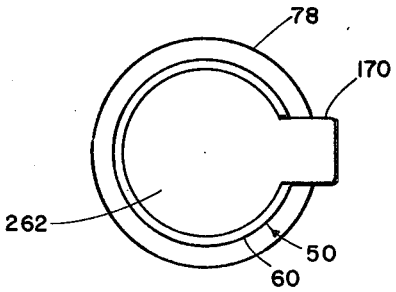
FIG. 3 is a detail showing the parts of FIG. 2 with the exception of a tress of hair.

Referring to FIG. 4, a modified socket 260 is there shown, which latter has inner and outer walls which are of cylindrical shape, having a cylindrical outer surface. All plugs preferably have closed upper sides terminating in flat planar surfaces as illustrated at 262 in FIG. 3, and 264 in FIG. 5.

The plug 96 of FIG. 5 illustrates that the tabs can be two in number, as shown at 272 and 274, so that the plug can be lifted from both sides, the tabs being opposite each other. FIG. 5 also illustrates that a plug can have a slit extending completely from one side thereof almost to the other side thereof, such a slit being seen at 280 and being for the purpose of allowing a tress or portion of hair 282 to extend upwardly through the slit 280 instead of using a compression between the side edges of a plug and the socket.

As can be seen, plugs of any shape could use the slit 280 or the principle of wedging hair against the inner side of the socket alternatively.

I claim:

1. A hair separator comprising a hair cover of water-proof material, said cover having openings through it for receiving therethrough selective tresses of hair which are to be selectively treated from other hair of the head of a person, annular sockets each surrounding one of said openings on the outer side of said cover, means securing said sockets to said cover, and plugs removably disposed one in each of said sockets and each forming a substantially water-proof sealing relationship with its socket, said plugs and their respective sockets forming plug and socket assemblies, which latter assemblies are sufficiently resilient and yielding as to achieve said substantially waterproof sealing relationship even at times when a tress of hair is extending upwardly alongside a portion of a socket so as to extend from an underside of said cover to an outer side of said cover where it can be selectively treated.

2. The hair separator of claim 1 in which said plugs each have a tab protruding therefrom on a portion thereof disposed on the other end thereof from said cover, said tabs serving as handles for the convenient removal of said plugs.

3. The hair separator of claim 2 in which at least one of said plugs further has a second tab spaced from said first tab.

4. The hair separator of claim 1 in which at least one of said plugs has a slit extending through it in a direction transverse to said cover so that a tress of hair can extend through said slit, said slit extending less than completely through its respective plug.

5. The hair separator of claim 1 having said plugs and sockets each having an outer side facing the same side of said cover, said plugs each having a handle thereon accessible from the outer side of said plug and socket assemblies.

6. The hair separator of claim 1 having said plugs and sockets each having an outer side facing the same side of said cover, said plugs each having a manually grippable means thereon accessible from the outer side of said plug and socket assemblies while said plugs are in their sockets, said manually grippable means being adequate to serve to be manually pulled on for removing said plugs from said sockets.

7. The hair separator of claim 1 having said sockets and plugs being shaped for the wedging of said plugs into their sockets for assuring a tight fit.

8. The hair separator of claim 1 and having said sockets being formed of a material more stiff than said cover, said cover being flexible.

9. The hair separator of of claim 1 having said sockets being formed of a material more stiff than said cover, said cover being flexible.

10. The hair separator of claim 1 having said sockets having flanges protruding outwardly to the sides thereof, said flanges lapping said cover so as to provide bonding areas of substantial size opposite said cover, said sockets being of separate pieces of material from said cover, and bonding material on said cover-lapping flange areas and securing said sockets to said cover.

* * * * *